United States Patent [19]

Krall

[11] Patent Number: 5,060,830

[45] **Date of Patent: * Oct. 29, 1991**

[54] DISPENSING PACKAGE FOR DISPENSING LIQUIDS

[75] Inventor: Thomas J. Krall, Toledo, Ohio

[73] Assignee: Owens-Illinois Plastic Products Inc., Toledo, Ohio

[ * ] Notice: The portion of the term of this patent subsequent to Jun. 5, 2007 has been disclaimed.

[21] Appl. No.: 463,699

[22] Filed: Jan. 11, 1990

[51] Int. Cl.[5] ..... B65D 37/00

[52] U.S. Cl. ..... 222/212; 222/207; 222/185; 222/519; 222/548

[58] Field of Search ..... 222/184, 185, 206, 207, 222/209, 211, 212, 215, 519, 522, 523, 548, 549, 555

[56] References Cited

U.S. PATENT DOCUMENTS

| | | | |
|---|---|---|---|
| 3,157,319 | 11/1964 | Schwienbacher | 222/207 |
| 3,651,995 | 3/1972 | Chaney | 222/211 |
| 4,324,349 | 4/1982 | Kaufman | 222/211 X |
| 4,516,697 | 5/1985 | Dreps et al. | 222/212 |
| 4,635,828 | 1/1987 | Kaufman | 222/212 X |
| 4,645,097 | 2/1987 | Kaufman | 222/212 X |
| 4,930,668 | 6/1990 | Krall | 222/207 X |

FOREIGN PATENT DOCUMENTS

| | | |
|---|---|---|
| 1389996 | 2/1964 | France . |
| 2442195 | 6/1980 | France . |

*Primary Examiner*—Kevin P. Shaver

[57] ABSTRACT

A dispensing package for dispensing liquid comprising an injection blow molded container having a flexible body and a neck comprising an outer wall and an inner wall. The inner wall defines a dispensing opening. A closure has a transverse wall, a peripheral skirt and a peripheral foot for engaging a flat surface. Interengaging means between the closure and the outer wall hold the transverse wall in sealing engagment with the inner wall of the neck for closing the dispensing opening. The closure is movable axially relative to the container between a first position sealingly engaging the neck of the container and a second position wherein fluid is permitted to flow to an outlet so that when the wall of the container is flexed a portion of the contents is dispensed. In one form, the outlet is in the skirt. In another form, the outlet is in the transverse wall.

9 Claims, 5 Drawing Sheets

DISPENSING PACKAGE FOR DISPENSING LIQUIDS

This application is a continuation-in-part of application Ser. No. 07/305,059 filed Feb. 2, 1989, now U.S. Pat. No. 4,930,668.

This invention relates to fluid dispensing packages and particularly to dispensing packages for metering quantities of a fluid when a wall of the container is flexed thereby dispensing a predetermined portion of the contents.

It has heretofore been suggested that fluid dispensing packages be provided wherein a quantity of fluid is dispensed upon flexing a portion of the container. Such a construction is disclosed in U.S. Pat. Nos. 4,324,349, 4,516,697 and 4,635,828, as well as French Patents 1,389,996 and 2,442,195.

Among the objectives of the present invention are to provide a fluid dispensing package of this type which is simpler in construction, does not require extra parts and can be readily manufactured.

In accordance with the invention, the dispensing package for dispensing liquid comprises an injection blow molded container having a flexible body and a neck comprising an outer wall and an inner wall. The inner wall defines a dispensing opening. A closure has a transverse wall, a peripheral skirt and a peripheral foot for engaging a flat surface. Interengaging means between the closure and the outer wall hold the transverse wall in sealing engagement with the inner wall of the neck for closing the dispensing opening. The closure is movable axially relative to the container between a first position sealingly engaging the neck of the container and a second position wherein fluid is permitted to flow to an outlet so that when the wall of the container is flexed a portion of the contents is dispensed. In one form, the outlet is in the skirt. In another form, the outlet is in the transverse wall.

DESCRIPTION

Figure 1:
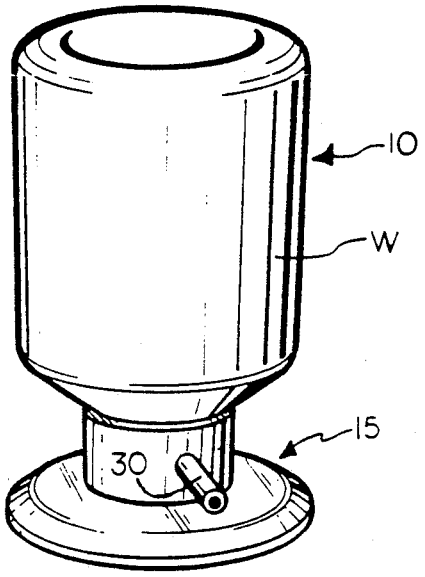
FIG. 1 is an elevational view of a fluid dispensing package embodying the invention.
Figure 4:
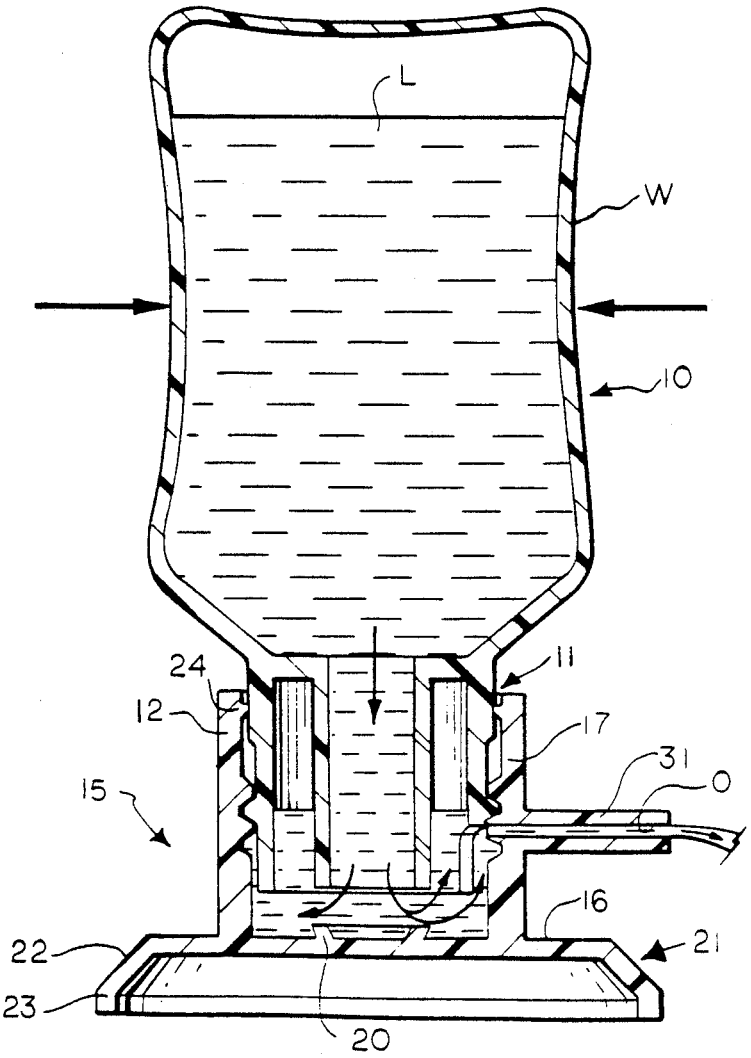
FIG. 4 is a sectional view similar to FIG. 3 showing the dispensing package during dispensing.

Referring to FIGS. 1–4, the fluid dispensing package embodying the invention comprises an injection blow molded plastic container 10 having an integral finish or a neck 11 that is formed by injection molding so that it comprises an integral outer wall 12 and an integral inner wall 13 joined by a connecting portion 14. The side wall W of the container 10 is flexible for dispensing the contents by external fluid pressure, as presently described. The inner wall 13 has an axial length slightly shorter than the outer wall 12 and defines a dispensing opening. A closure 15, preferably made of plastic, comprises a transverse wall 16 and a peripheral skirt 17. The skirt 17 has internal grooves 18 adapted to engage external ring 19 on the outer surface of the outer wall 12 to interengage the closure 15 with the container 10 during storing and handling. The closure 15 further includes an annular flexible lip 20 that extends radially outwardly toward the skirt 17 for sealingly engaging the upper surface of the inner wall 13 and thereby sealing the liquid contents L in the container 10.

The closure 15 further includes an integral base for engaging a flat surface to hold the package in inverted position. Base 21 comprises an inclined annular wall 22 and a base engaging rib or flange 23. The closure 15 further includes a laterally extending tube 31 defining an opening O.

The closure 15 further shows annular flexible lip 24 which extends radially inward from skirt 17 for sealingly engaging the outer wall 12 and thereby cooperates with external ring 19 and internal grooves 18 to seal the chamber formed by closure 17 and container 10 when the closure 15 is in the second or open position.

Figure 2:
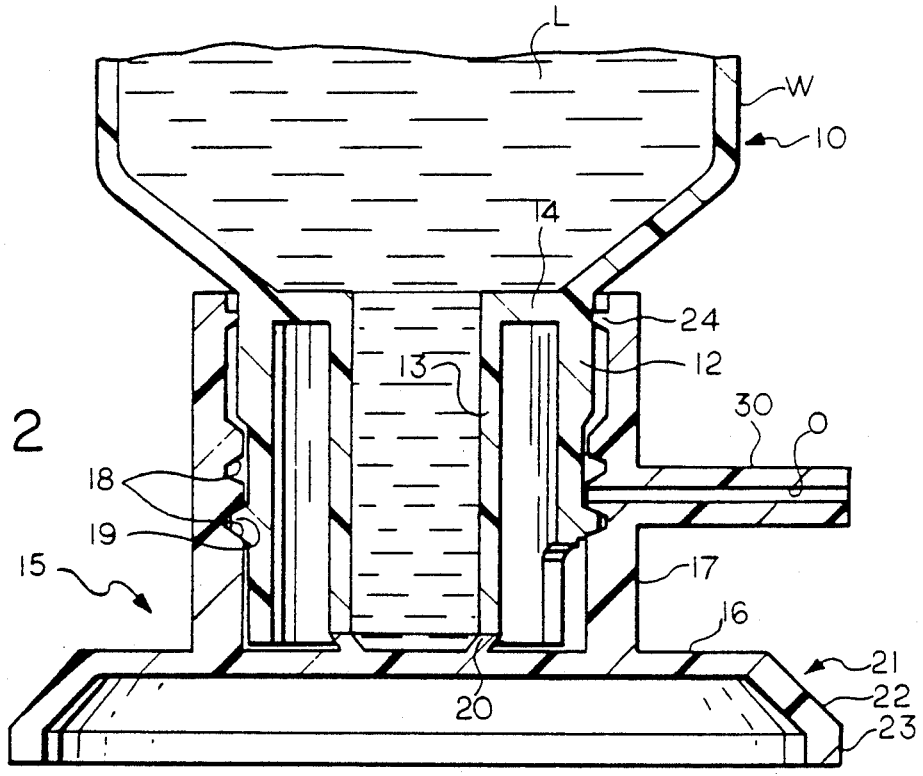
FIG. 2 is a fragmentary sectional view on a enlarged scale showing the package, the parts arranged for fluid dispensing.
Figure 3:
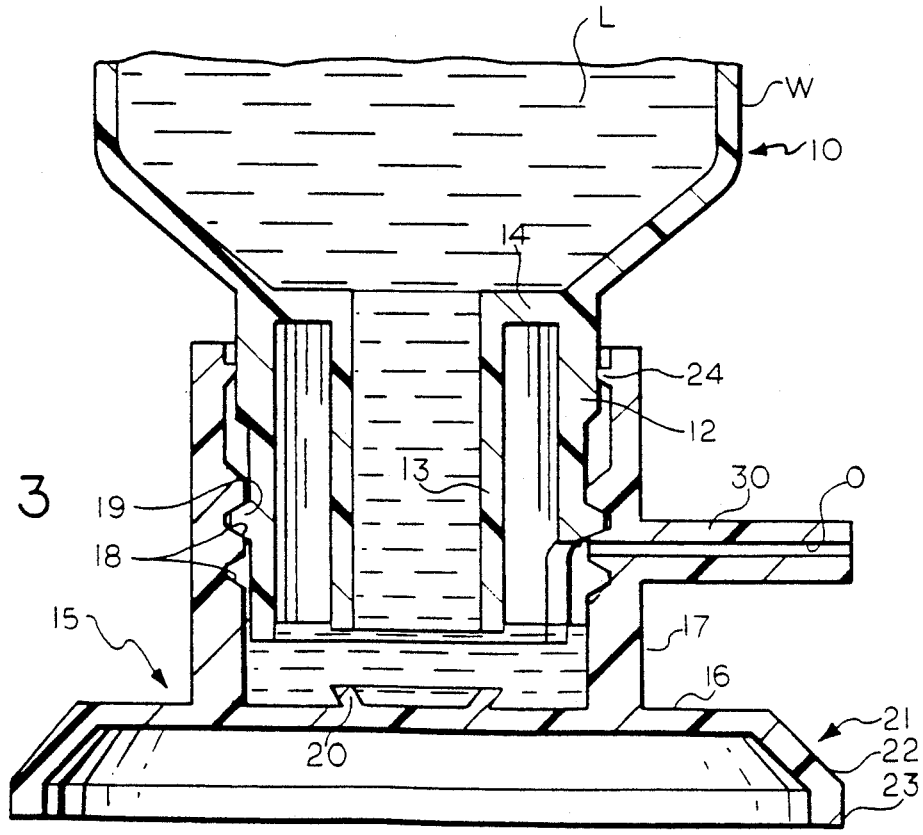
FIG. 3 is a sectional view similar to FIG. 2 showing the relative position of the parts ready for dispensing.

In a first position shown in FIG. 2, the closure sealingly engages the neck 11 through the flexible lip 20 engaging the free end of the inner wall 13. The closure 15 can be moved to the second position as shown in FIG. 3.

When the wall W of the container is flexed a portion of the contents L is dispensed through the opening in the neck to the opening O in the skirt.

Figure 5:
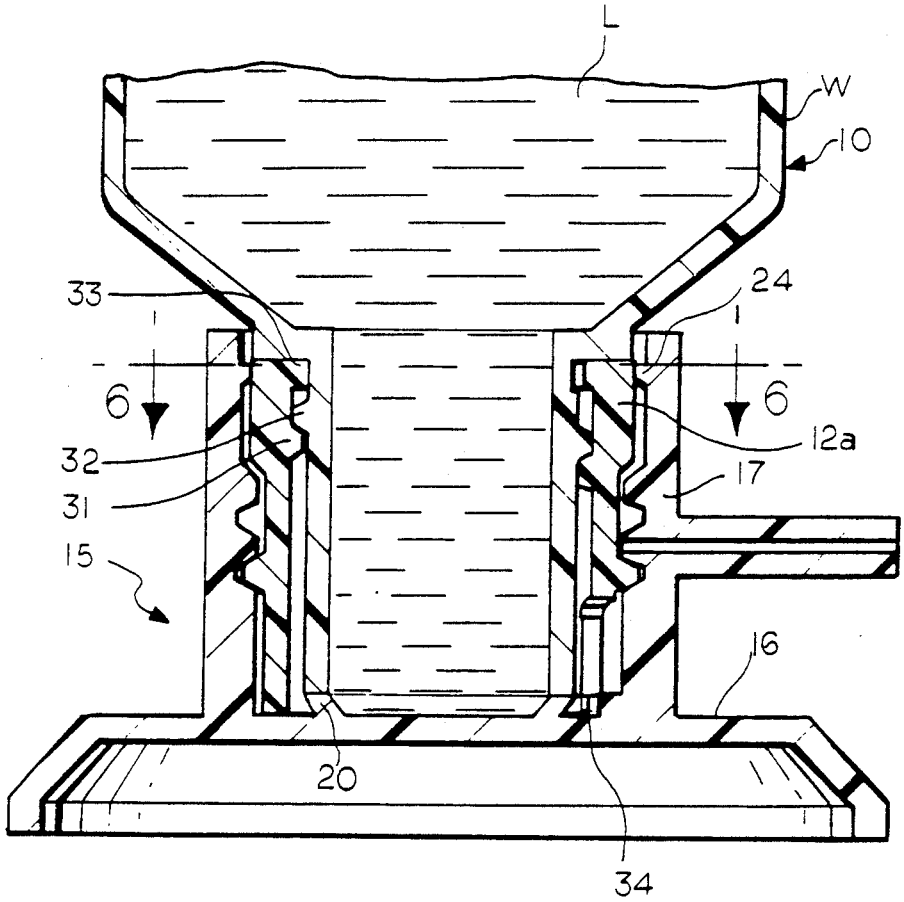
FIG. 5 is a fragmentary sectional view of a modified form of fluid dispensing package.
Figure 6:
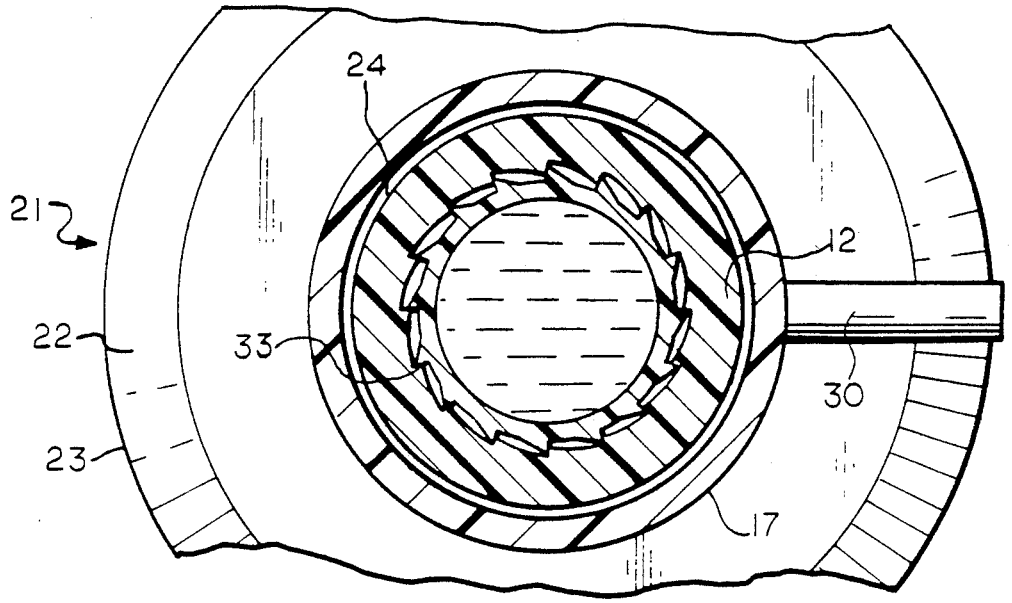
FIG. 6 is a fragmentary sectional view taken along the line 6—6 in FIG. 5.

In the modified form of package shown in FIG. 5, the inner wall **12*a* is formed as a separate fitment that is provided with a thread 31 on the inner surface thereof engaging a complementary thread 32 on the outer surface of the inner wall 12*a*. Wall 12*a* includes circumferentially spaced unsymmetrical external teeth 33 which cooperate with circumferential complimenting external lugs 34 on the skirt 17 of the juncture of skirt 17 and wall 16. This forms a one-way ratchet locking the element 12*a* against rotation relative to skirt 17. In all other respects, the structure is as shown in FIGS. 1–4**.

Figure 7:
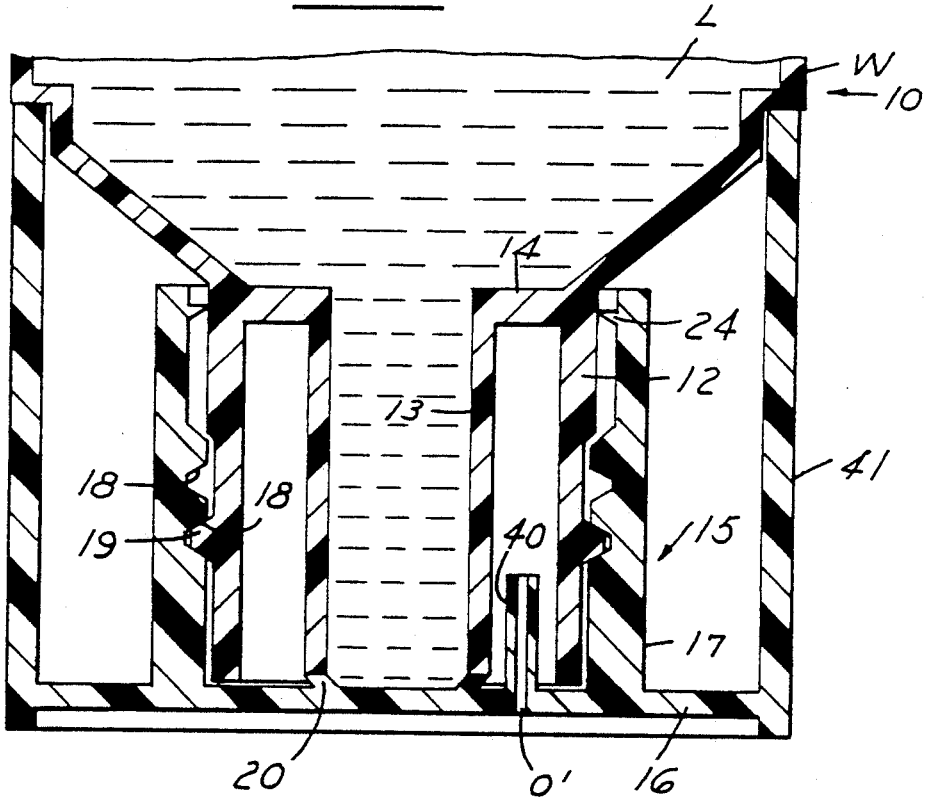
FIG. 7 is a fragmentary sectional view on an enlarged scale of a another modified form of fluid dispensing package.
Figure 8:
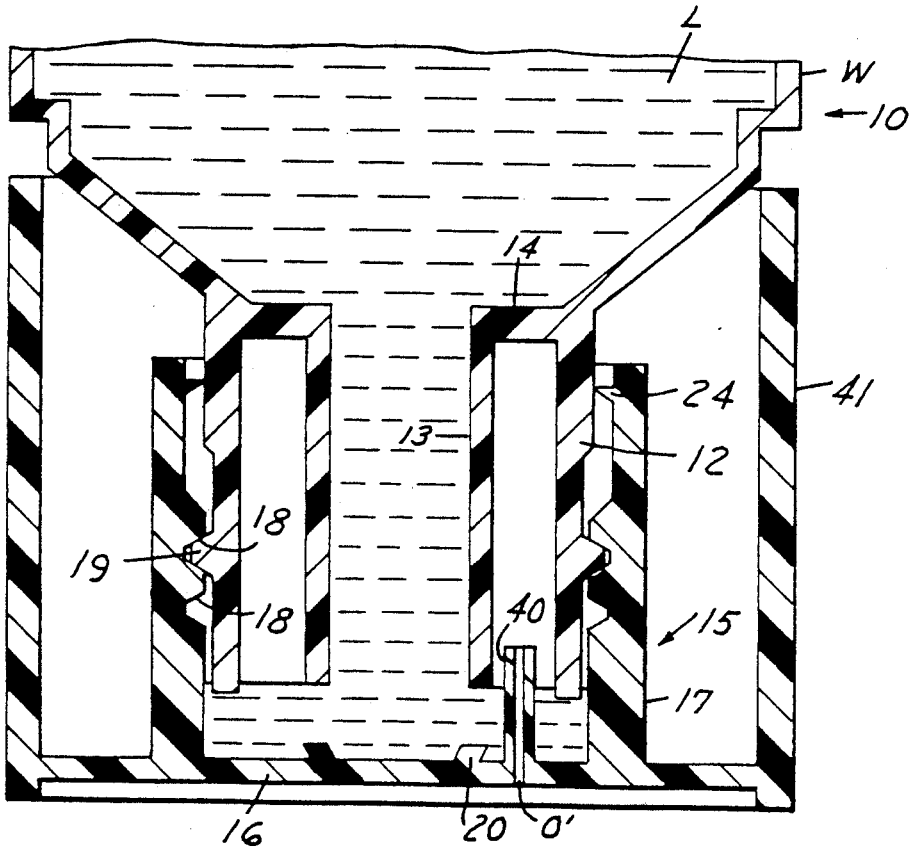
FIGS. 8 and 9 are sectional views of the package shown in FIG. 6 showing the parts in different operative position.
Figure 9:
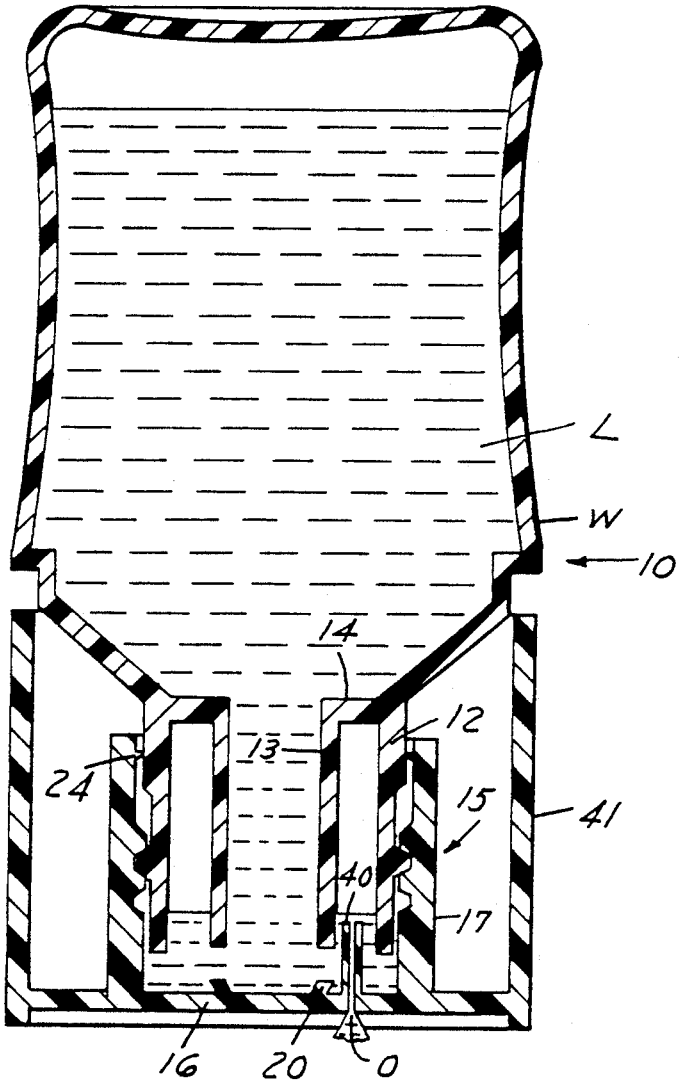

The fluid dispensing package shown in FIGS. 7–9 is substantially the same as that shown in FIGS. 1–4 except that the closure includes an integral cylindrical wall 41 and dispensing opening O is provided in the transverse wall 16 and includes a tube 40 that extends upwardly into the space between the outer 12 and inner wall 13 of the neck of the container.

In the first position shown in FIG. 7, the closure sealing engages the neck through the flexible lip 20 engaging the free end of the inter wall. The closure can then be moved to the second position as shown in FIG. 8. When the wall W of the container is flexed, a portion of the contents is dispensed through the opening O in the transverse wall 16 as shown in FIG. 9.

Figure 10:
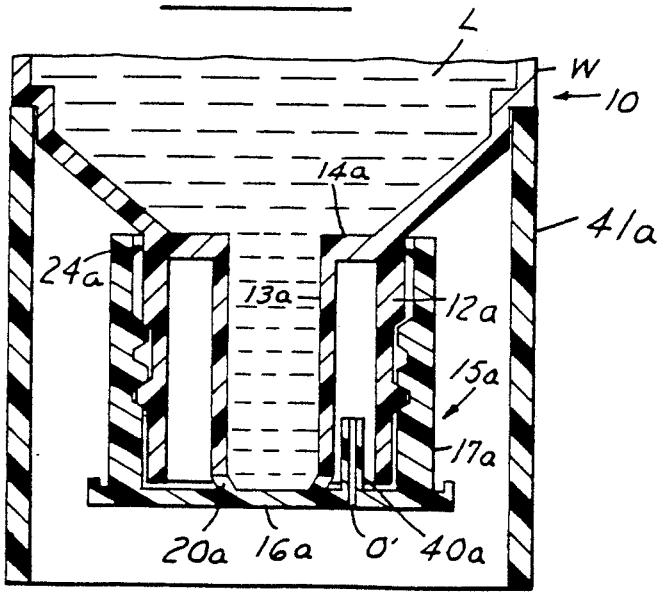
FIG. 10 is a fragmentary sectional view of an another modified form of fluid dispensing package.

In the form shown in FIG. 10, the closure **15*a* is provided separately from the base or foot. The base 41*a* comprises a cylinder secured to a shoulder on the bottle 10 by adhesive or the like. Otherwise, the closure functions in the same manner as that described in connection with FIGS. 7–9**.

It can thus be seen that there has been provided a free standing fluid dispensing package of this type which is simpler in construction, does not require extra parts and can be readily manufactured.

I claim:

1. A dispensing package for dispensing liquid comprising:

an injection blow molded container having a flexible body, an integral neck comprising an integral outer wall and an integral inner wall defining a space between said outer wall and said inner wall, said space being closed at one end nearest the container and open at the other end, said inner wall defines a dispensing opening, a plastic closure having a transverse wall, a peripheral skirt and a base for engaging a flat surface or the like, said closure having an outlet opening, interengaging means between the closure and the outer wall for holding the transverse wall in sealing engagement with the inner wall of the neck for closing the dispensing opening, means providing a seal between the skirt of the closure and the outer surface of the outer wall, said closure being movable axially between a first position sealingly engaging the neck of the container and a second position wherein fluid is permitted to flow through the dispensing opening and to said outlet opening in the closure so that when the flexible body of the container is thereafter compressed a predetermined quantity of the contents is dispensed through the outlet opening in the closure.

2. The dispensing package set forth in claim 1 wherein including means for sealing said closure to said neck comprises an annular lip on said transverse wall of said closure engaging the inner wall of the neck of the container.

3. The dispensing package set forth in claim 1 including sealing means between said skirt of said closure and said outer wall of said container.

4. The dispensing package set forth in any one of claims 1, 2 and 3 wherein said outlet opening is in said skirt of said closure.

5. The dispensing package set forth in any of claims 1, 2 and 3 wherein said outlet opening is in the transverse wall of said closure and includes a tube extending axially into said space between said outer wall and said inner wall of said neck of said container.

6. A dispensing package for dispensing liquid comprising:

an injection blow molded container having a flexible body, a neck comprising an outer wall and an inner wall, said inner wall defines a dispensing opening, a plastic closure having a transverse wall, a peripheral skirt and a peripheral foot for engaging a flat surface or the like, interengaging means between the closure and the outer wall for holding the transverse wall in sealing engagement with the inner wall of the neck for closing the dispensing opening, said closure being movable axially between a first position sealingly engaging the neck of the container and a second position wherein fluid is permitted to flow through said dispensing opening to an outlet in the closure when the flexible body of the container is compressed a predetermined quantity of the contents is dispensed through the outlet in the closure, said outer wall of said container being formed as a separate plastic part and including interengaging means between said outer wall of the container and said closure for preventing relative rotation in at least one direction.

7. The dispensing package set forth in claim 6 wherein said interengaging means comprises threads on the inner surface of the part and on the outer surface of the inner wall of the container.

8. The dispensing package set forth in claims 6 and 7 wherein said outlet is in said skirt of said closure.

9. The dispensing package set forth in any of claims 6 and 7 wherein said outlet is in the transverse wall of said closure and includes a tube extending axially into said space between said outer wall and said inner wall of said neck of said container.

* * * * *